United States Patent [19]

Kenig

[11] Patent Number: 4,858,390

[45] Date of Patent: Aug. 22, 1989

[54] BELT GRINDER ATTACHMENT FOR POWERED ROTARY TOOLS

[76] Inventor: Nisan Kenig, 12415 Grove Meadow, Stafford, Tex. 77477

[21] Appl. No.: 294,928

[22] Filed: Jan. 5, 1989

Related U.S. Application Data

[63] Continuation of Ser. No. 58,136, Jun. 4, 1987, abandoned.

[51] Int. Cl.[4] ..... B24B 21/00

[52] U.S. Cl. ..... 51/135 R; 51/170 EB

[58] Field of Search ..... 51/135 R, 170 EB, 148, 51/147

[56] References Cited

U.S. PATENT DOCUMENTS 2,301,853 11/1942 Cannon .
3,427,757 2/1969 Redman .
3,510,988 5/1970 Mason .
3,643,385 2/1972 Mikiya ..... 51/170 EB

*Primary Examiner*—Frederick R. Schmidt
*Assistant Examiner*—Maurina Rachuba
*Attorney, Agent, or Firm*—Russell J. Egan

[57] ABSTRACT

A belt grinder attachment for powered rotary tools mounts an abrasive belt for movement transverse to the axis of the tool for ease of alignment of the belt on a work piece. The attachment body member can either be threaded onto the tool housing or be clamped thereon. An arm extends from the body member and is radially adjustable for tensioning the belt. A driven pulley assembly is mounted on the free end of the arm and provides for the belt to run either directly on opposite sides of the arm or to one side only. The normal chuck of the tool is replaced by a drive pulley and the belt extends around both the drive and driven pulleys.

19 Claims, 2 Drawing Sheets

BELT GRINDER ATTACHMENT FOR POWERED ROTARY TOOLS

This is a continuation of co-pending application Ser. No. 58,136 filed on June 4, 1987, now abandoned.

BACKGROUND OF THE INVENTION

1. Field of the Invention

The present invention relates to a belt grinder attachment for powered rotary tools and in particular to a belt grinder attachment in which the grinding belt traverses a path normal to the axis of the tool for improved control of belt positioning on the work piece.

2. Description of the Prior Art

There is a very popular concept powered rotary tool manufactured by a number of companies and marketed under a variety of tradenames. Each tool has an electric motor mounted in a handle and adapted to drive a chuck on a free end of the tool. The chuck is adapted to receive a wide variety of rotary tool accessories, such as drill bits, saw blades, sanding discs and drums and similar rotary operating devices. These tools are widely used by both hobbyist and the professional craftsman for tool and model making and similar detailed work.

Theretofor these tools have generally been restricted to using only disc and drum grinding and sending devices as no suitable belt grinder attachments have been available. Some of the problems of the prior art belt grinder devices included difficulty of attachment to the basic tool, including propritary attachment to only the tools of the belt grinder manufacturer. Further problems were the attachment had the belt running generally along the axis of the tool making positioning of the belt against the work piece difficult in many instances. An example of this type of in-line tool attachment can be found in U.S. Pat. No. 3,496,679. Another example of a belt grinder attachment can be found in U.S. Pat. No. 2,301,853. However, this attachment presents a number of different problems. This patent shows a tool which is mounted in a handle and the belt grinder attachment is mounted parallel to the handle, normal to the axis of the tool, the handle, tool and attachment forming a generally U-shape. This arrangement creates a parallax problem for the worker in trying to control the belt. It is necessary to have guide means provided on this assembly to both support and correctly position the belt with respect to the work piece.

Examples of belt grinder attachments for hand drills can be found in U.S. Pat. Nos. 2,976,652 and 3,566,549. Examples of minature belt grinding devices may be found in U.S. Pat. Nos. 3,427,757; 3,510,988; 3,619,949; and 3,643,385. None of the devices shown in the latter group of patents could be readily adapted as an attachment for an existing powered rotary tool.

The present invention overcomes many of the above discussed problems of the prior art.

SUMMARY OF THE INVENTION

The present invention is a belt grinder attachment for any of the well known powered rotary tools. The attachment has a body portion adapted to be threadedly mounted or clamped on such tools adjacent the chuck end of the tool. An adjustable and spring biased belt supporting arm extends from the body and carries a driven pulley assembly at its free end. A drive pulley replaces the chuck of the tool and an endless grinding belt is placed about the two spaced pulleys. Thus the belt extends normal to the axis of the tool and is placed close to the tool so that there is no problem of control of the belt with respect to the work piece. The belt supporting arm is biased axially by spring means for tensioning of the belt and the driven pulley assembly is free for rotation about the axis of the arm for controlling the positioning of the belt. The arm and body can have one of two configurations providing either an inline mounting to the belt, that is the belt extending directly over and on both sides of the arm, or off set to be parallel to and on one side of the arm. The subject belt grinding attachment can also be used with the tool mounted in a bench fixture.

BRIEF DESCRIPTION OF THE DRAWINGS

The present invention will be described, by way of example, with reference to the accompanying drawings in which.

DETAILED DESCRIPTION OF THE PREFERRED EMBODIMENTS

Figure 1:
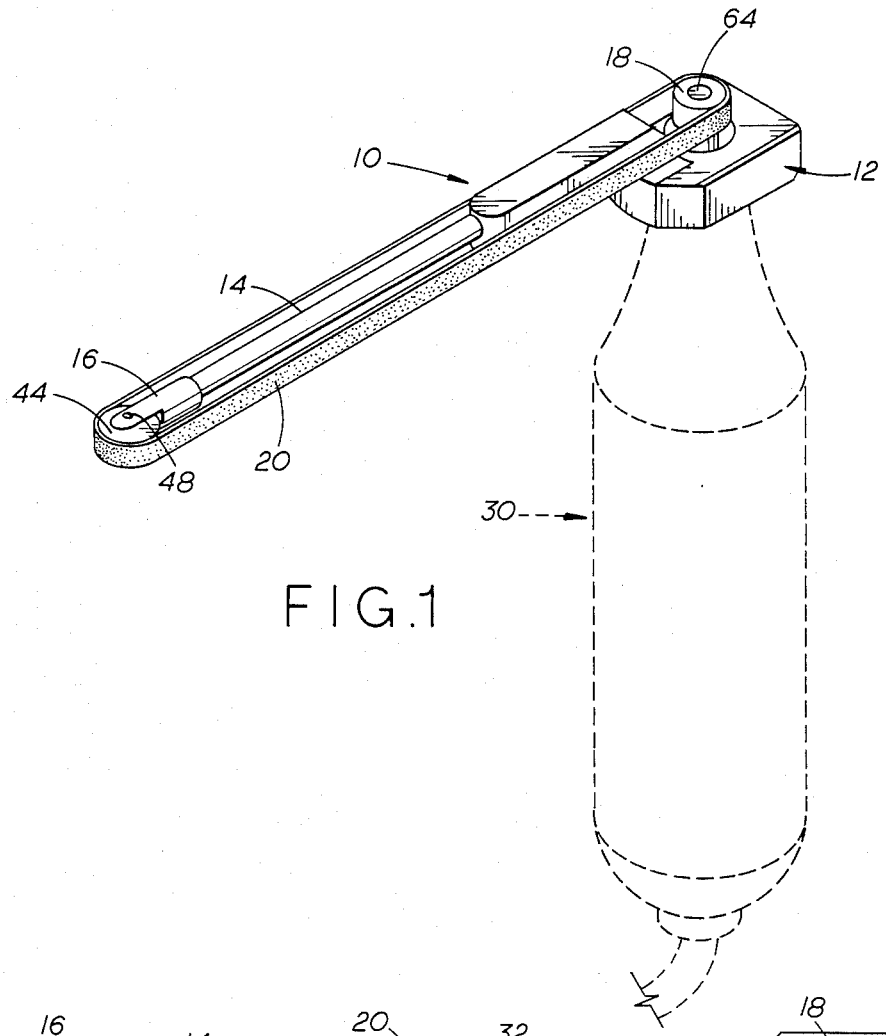
FIG. 1 is a perspective view of a first embodiment of the present invention.
Figure 2:
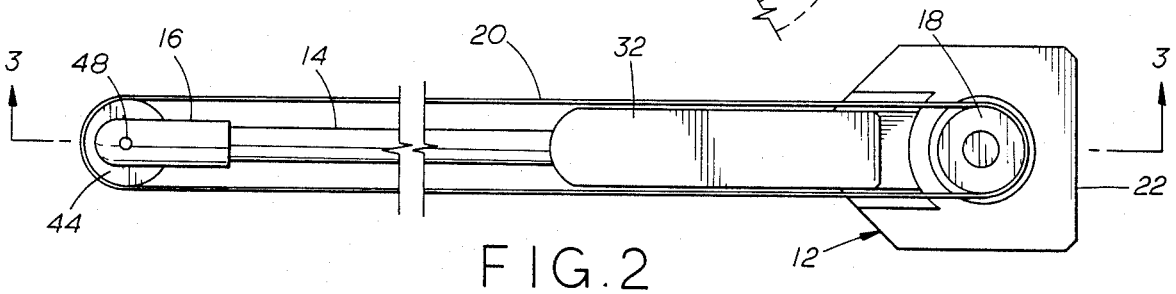
FIG. 2 is a top plan view of the embodiment of FIG. 1.

The subject invention is a belt grinder attachment for rotary powered tools of a well known type. The preferred embodiment of subject belt grinder attachment invention 10 is shown in FIGS. 1 to 3 and is formed by a base member 12, a preferably integral arm 14 extending radially from the member 12, a driven pulley assembly 16 on the free end of the arm, a drive pulley 18 replacing the chuck (not shown) of the tool and an endless sanding or grinding belt 20 placed around the pulleys.

Figure 3:
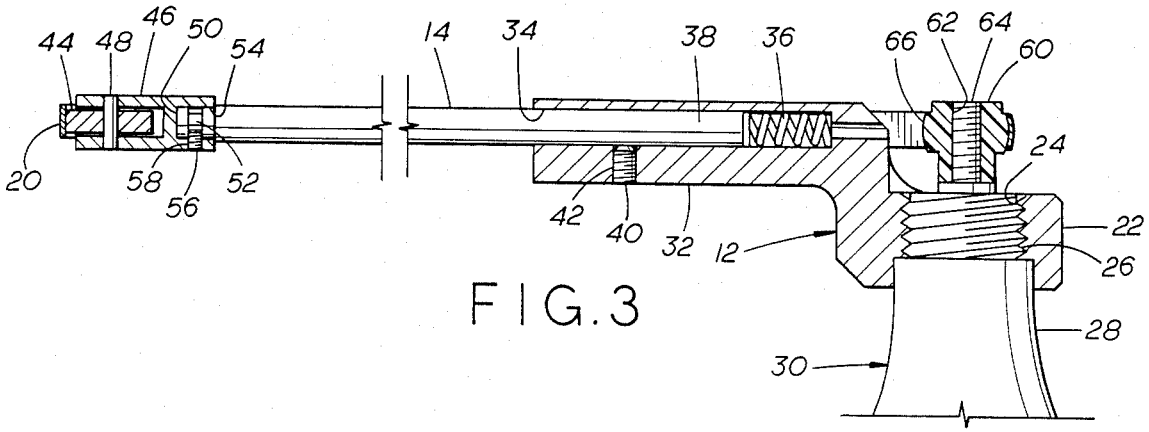
FIG. 3 is a section taken along line 3—3 of FIG. 2.

Turning now to the details, as shown in FIG. 3, the base member 12 has a body portion 22 defining a central internally threaded bore 24 adapted to be received on the threaded end 26 of the housing 28 of the rotary tool 30. A preferably integral extension 32 projects radially and slightly axially offset from the body portion 22 and contains an axial bore 34. The bore 34 receives therein compression spring 36 and one end 38 of the arm 14. The arm 14 is adjustably fixed in bore 34 by set screw 40 in threaded bore 42 which intersects the bore 34 normal to the axis thereof. The driven pulley assembly 16 includes driven pulley 44 mounted in member 46 on shaft 48. The end 50 of arm 14 has an annular recess 52 and is received in bore 54 in member 46. The member 46 is held in place on arm 14 by set screw 56 threaded into a bore 58 in member 46 and entering into groove 52. This set screw 56 and annular groove 52 fixes the assembly 16 axially on the arm 14 while allowing rotation of member 46 about the axis of arm 14 for positioning the belt 20, as will be explained later.

Drive pulley 18 has a profiled body 60 with an internally threaded bore 62 recieved on the threaded chuck shaft 64 of the tool 30 after the chuck (not shown) has been removed. The external profile of the body 60 includes an annular protrusion 66 upon which the belt 20 rides.

The belt 20 is of standard construction with an endless flexible member having abrasive materials adhered to the outer surface thereof. The belt member, the abrasive materials and the adhesive may be selected from any of the wide variety of well know materials. Likewise, the dimensions of the width and length of the belt can be selected according to need.

This embodiment of the invention is mounted on the tool 30 by simply threading the portion 26 of the tool housing 28 into the threaded bore 24 of the body portion 22. The chuck (not shown) is removed from the threaded drive shaft 64 and the drive pulley 18 threaded onto the shaft. The arm 14, which can initially be loosely or fixedly mounted in the bore 34, is adjusted for belt length and fixed by the set screw 40. This adjustment is accomplished by placing a belt 20 around the drive and driven pulleys 18,16, respectively, and then properly positioning the arm 14 for the desired belt tension.

A particular advantage of this preferred embodiment is the positioning of the belt 20 directly over opposite sides of the arm 14. Thus the subject belt grinder attachment 10 has a low profile and can be used on workpieces positioned to either side of the attachment. This is very useful when there is limited space in which to work.

The mounting of the driven pulley assembly 16 allows for a rotating float on the arm 14 so that the assembly 16 will accomodate transverse movement of the belt 20 to assure proper positioning of the belt on the pulleys at all times and reduce the chances of the belt becoming disengaged from the pulleys.

Figure 4:
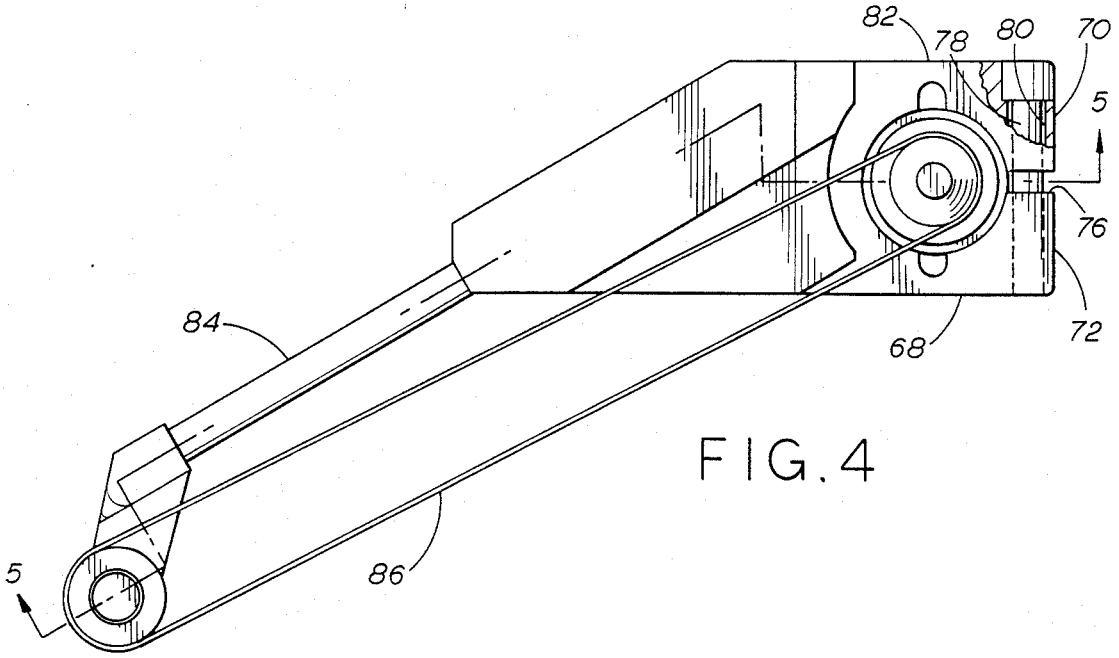
FIG. 4 is a top plan view of an alternative embodiment of the invention.
Figure 5:
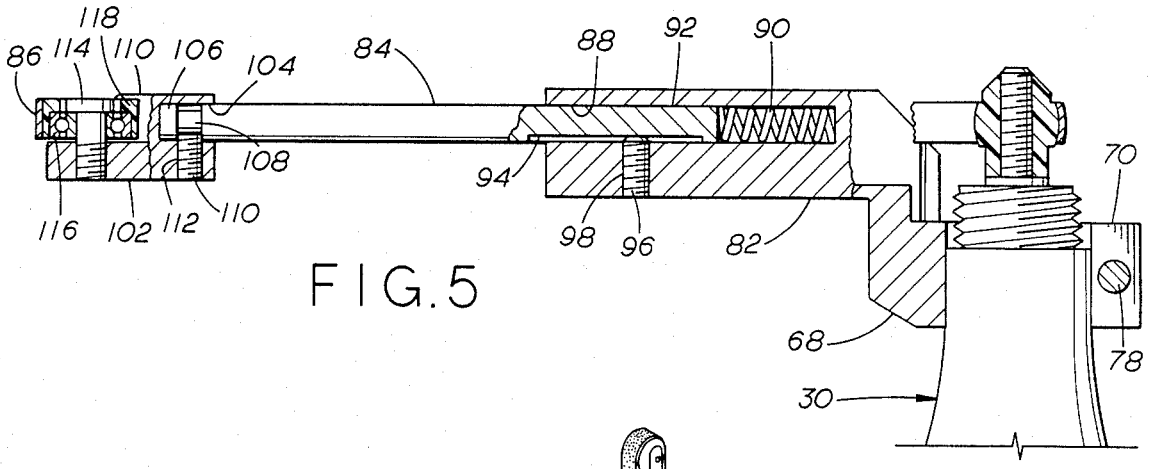
FIG. 5 is a section taken along line 5—5 of FIG. 4.

A second embodiment of the present invention is shown in FIGS. 4 and 5. In this embodiment, the body 68 has a pair of arms 70,72 defining a central bore 74 with a slot 76 to one side. One arm 70 has a bore 78 and the other arm 72 has a threaded bore 80 aligned with bore 78. A mounting screw 82 extends through bore 78, spans the slot 76 and engages in the threaded bore 80. When the screw 82 is rotated, it draws the arms 70,72 together to secure the body 68 on the tool 30. This embodiment has a preferably integral extension 82 which is both radially and axially offset from the body 68 so that the arm 84 mounted therein lies parallel to and outside the path of the belt 86, as best seen in FIG. 4. In this embodiment extension 82 has a bore 88 which recieves a compression spring 90 and one end 92 of the arm 84. This end of the arm has a longitudinally extending groove 94. A set screw 96 is mounted in threaded bore 98 and enters bore 88 and groove 94 to restrict the rotational movement of the arm 84 while allowing axial movement. The driven pulley assembly 100 has a member 102 with a bore 104 receiving the other end 106 of arm 84. This end of the arm has an annular groove 108 which receives the set screw 110 from threaded bore 112. The member 102 is profiled to receive a shaft 114 having bearing 116 and pulley 118 thereon. The drive pulley 18 in this embodiment is identical to the drive pulley of the preferred embodiment.

This embodiment of the invention can operate on workpieces which are positioned to only one side of the arm 84, as will be best understood from FIG. 4.

Figure 6:
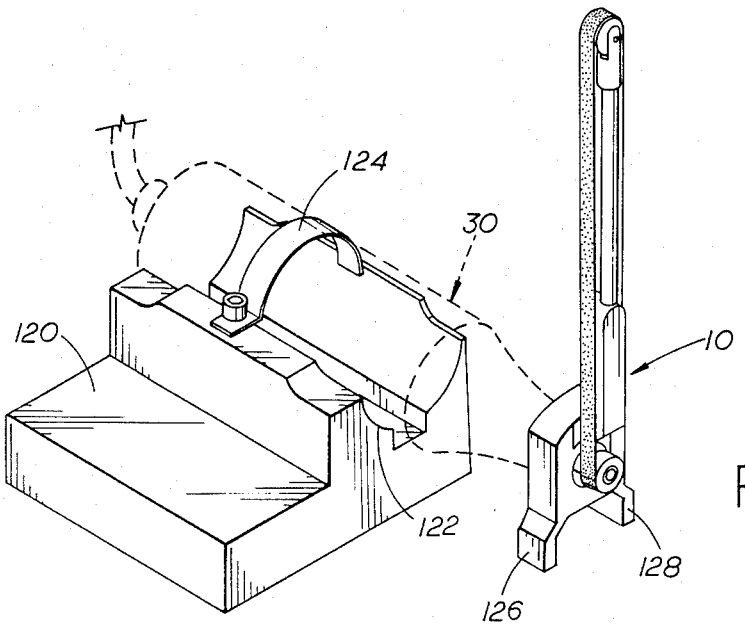
FIG. 6 is a perspective view of a tool provided with the present invention and mounted in a bench or fixed mount.

FIG. 6 shows a bench mounting block 120 which can be used with the present invention to make a stationary grinder. The block 120 includes a profiled recess 122 for the tool 30 and a clamp 124 to secure the tool in place.

Another alternative to the present invention is to have the outer surface of the drive pulley slightly inclined forming a conical upper surface. This allows the belt to be slipped onto the pulley without changing the fixed position of the arm.

A still further alternative is to have legs 126,128 extending from the side of the body member opposite the arm 14,84 to enable the tool and subject attachment to be placed on a surface with the belt directed away from the surface preventing contact with the surface. The special advantage of this enbodiment is that is saves the belt and the tool should there be some residual movement of the belt when the tool is placed on the surface.

The foregoing disclosure and description of the subject invention are intended as being illustrative and explanatory thereof. Various changes in the details of the illustrated embodiments may be made without departing from the spirit or the intended scope of the appended claim.

I claim:

1. A belt grinder attachment in combination with a hand held rotary powered tool, said attachment comprising:

a body member having a first axial through bore adapted to receive one end of said tool therein, and a second blind bore in said body member extending normal to the axis of said first bore;

a straight unitary arm having one end received in said second blind bore to extend substantially normal to an elongated axis of the tool;

spring means in said second blind bore biasing said arm outwardly from said body member;

a driven pulley assemby mounted on the opposite free end of said arm and within a plane defined by said arm, said plaane lying normal to the axis of said first axial through bore, said assembly including a driven pulley mounted for rotation about its own axis which is normal to the plane of said arm;

a drive pulley adapted to be mounted on one end of and driven by the tool, said drive pulley being positioned in said plane and aligned with said driven pulley; and an endless grinding belt mounted on and passing around said drive and driven pulleys to follow a path along said plane with the width of said belt extending normal to said plane.

2. A belt grinder attachment according to claim 1 wherein said first through bore defines an internally threaded bore adapted to receive therein an externally threaded portion of said tool.

3. A belt grinder attachment according to claim 1 wherein said body member has a pair of arms defining said through bore, one arm having a smooth bore therein and the other arm having an aligned internally threaded bore; and screw means received in the bore of said on e arm and threadedly engaging the bore of said other arm whereby said arms can be drawn together to secure said attachment to said tool.

4. A belt grinder attachment according to claim 1 wherein said body member has an extension directed normal to the longitudinal axis of said tool; and said second blind bore is in said extension receiving said one end of said arm therein.

5. A belt grinding attachment according to claim 4 wherein said extension is stepped axially with respect to the longitudinal axis of said tool whereby the driven pulley assembly is aligned with the drive pulley and said belt traverse a path along two opposite sides of said arm whereby said belt can be applied to a workpiece positioned to either side of said attachment.

6. A belt grinding attachment according to claim 4 wherein said extension is offset parallel to a radius from said tool whereby said arm lies outside the path of travel of said belt.

7. A belt grinding attachment according to claim 4 wherein said extension has a threaded bore intersecting said blind second bore;

a set screw received in said threaded bore engaging said one end of said arm to fixedly position said arm in said body member.

8. The belt grinding attachment according to claim 7 wherein said first end of said arm is profiled with a longitudinally extending groove receiving said set screw therein whereby rotational movement of said arm is prevented while axial movement is permitted.

9. A belt grinding attachment according to claim 1 wherein said driven pulley assembly comprises:

a member having a bore receiving therein said free end of said arm;

a driven pulley; and means mounting said driven pulley in said member.

10. A belt grinding attachment according to claim 9 wherein said means mounting said pulley is a shaft passing through said driven pulley and portions of said member.

11. A belt grinding attachment according to claim 9 wherein said means mounting said pulley includes a bearing.

12. A belt grinding attachment according to claim 9 wherein said driven pulley is mounted for rotation in line with said arm.

13. A belt grinding attachment according to claim 9 wherein said driven pulley is mounted for rotation offset parallel to said arm.

14. A belt grinding attachment according to claim 9 wherein said member has a threaded bore intersecting said bore;

an annular groove in and adjacent the free end of said arm; and a set screw mounted in said threaded bore engaging in said annular groove allowing rotational movement of said assembly about said arm while preventing axial movement along said arm.

15. A belt grinding attachment according to claim 1 wherein said drive pulley is profiled for ease of mounting a belt thereon.

16. A belt grinding attachment according to claim 15 wherein the upper surface of said drive pulley is conical.

17. A belt grinding attachment according to claim 1 wherein said driven pulley has a body portion defining a central threaded bore receiving therein a threaded drive shaft of said tool.

18. A belt grinding attachment according to claim 1 wherein said driven pulley has an exterior profile adapted to maintain a belt thereon on proper position.

19. A belt grinding attachment according to claim 1 further comprising at least one leg extending from said body member normal to the axis of said tool and opposite the direction of said arm whereby said tool and attachment can be placed on a surface with said belt directed away from said surface preventing contact therewith.

* * * * *